US006028571A

United States Patent [19]

Eglit

[11] Patent Number: 6,028,571

[45] Date of Patent: Feb. 22, 2000

[54] DIGITAL DISPLAY UNIT IN A COMPUTER SYSTEM WITH AN IMPROVED METHOD AND APPARATUS FOR DETERMINING A SOURCE MODE USING WHICH A RECEIVED ANALOG DISPLAY SIGNAL WAS GENERATED

[75] Inventor: Alexander Julian Eglit, Half Moon Bay, Calif.

[73] Assignee: Paradise Electronics, Inc., San Jose, Calif.

[21] Appl. No.: 09/035,261

[22] Filed: Mar. 5, 1998

[51] Int. Cl.[7] ..... G09G 5/00

[52] U.S. Cl. ..... 345/3; 345/132

[58] Field of Search ..... 345/3, 2, 1, 87, 345/88, 89, 98, 127, 132, 112, 150, 154, 212, 213

[56] References Cited

U.S. PATENT DOCUMENTS

| | | | |
|---|---|---|---|
| 5,430,457 | 7/1995 | Zenda | 345/3 |
| 5,742,261 | 4/1998 | Yuki et al. | 345/3 |
| 5,841,430 | 11/1998 | Kurikko | 345/3 |

*Primary Examiner*—Xiao Wu
*Attorney, Agent, or Firm*—Law Firm of Naren Thappeta

[57] ABSTRACT

A digital display unit which accurately determines a graphics source mode using which an analog display signal has been generated. Accurate determination of the source mode enables images encoded in the received display signal to be reproduced properly on a digital display screen. Some of the display signal parameters are measured by examining the display signal. The measured parameters are compared with corresponding stored parameters for each stored mode. A match of parameters is deemed to exist if the compared values are within an associated tolerance level. A source mode matching with all matching parameter is selected to process a display signal. The tolerance level is adaptively varied to select a suitable source mode.

24 Claims, 4 Drawing Sheets

DIGITAL DISPLAY UNIT IN A COMPUTER SYSTEM WITH AN IMPROVED METHOD AND APPARATUS FOR DETERMINING A SOURCE MODE USING WHICH A RECEIVED ANALOG DISPLAY SIGNAL WAS GENERATED

RELATED APPLICATIONS

The present application is related to the co-pending U.S. patent application entitled "Digital Display Unit in a Computer System for Enabling a User to Conveniently Select a Desired Monitor mode for Displaying Images Encoded in a Received Analog Display Signal", Ser. No. 09/02,3815, filed Feb. 13, 1998, attorney docket number PRDS-0008, and is incorporated in its entirety into the present application herewith.

BACKGROUND OF THE INVENTION

1. Field of the Invention

The present invention relates to computer graphics systems, and more specifically to a method and apparatus implemented in a digital display unit of a computer system for determining a source graphics mode using which a received analog display signal was generated.

2. Related Art

Digital display units (e.g., flat panel monitors) are often used to display images encoded in an analog display signal. A signal in SVGA format generated by a graphics controller circuit of a computer system is an example of such an analog display signal. An analog display signal generally includes display data signal and corresponding synchronization signals. The display data signal identifies a color intensity for each point of an image and the synchronization signals provide a time reference such that each portion of the display data signal can be correlated with a corresponding portion of the image.

In general, an analog display signal includes multiple frames, with each frame corresponding to an image. Each frame in turn includes multiple horizontal lines. The synchronization signals typically include horizontal and vertical synchronization signals to indicate transitions to next horizontal line and next frame respectively in the associated display data signal.

To reproduce the encoded images, a digital display unit needs to operate consistent with an encoding scheme used by a graphics source (e.g., graphics controller circuit of a computer system). The encoding scheme is typically characterized by display signal parameters, and a given set of values for the display signal parameters defines a "source mode". For example, each source mode may be characterized by the refresh rate (number of frames encoded in the display signal per second), the number of lines in each frame, the number of points forming each horizontal line, among others.

As an illustration, the alphanumeric mode of the VGA standard may have a refresh rate of 70 Hertz (i.e., number of frames per second), with each frame including 400 horizontal lines (source image height) and each horizontal line including 720 pixel data element samples (source image width). The need for a digital display unit to operate consistent with the source mode for proper reproduction can be appreciated by considering the manner in which an example analog display signal is generated.

In a typical situation, a source image is represented by a plurality of pixel data elements at a graphics source (e.g., graphics controller circuit of a computer system), with each pixel data element representing a point (pixel position) on the image. In the case of the alphanumeric mode of the VGA standard, a source image may be stored as 720 (source image width)×400 (source image height) pixel data elements. A graphics source generates an analog display signal with image frames by converting each pixel data element into corresponding display data signal. A digital to analog converter (DAC) and a source clock (dot clock) are typically used for such a conversion.

As the analog display signal is typically designed to operate in conjunction with analog display monitors which need time for horizontal retrace while scanning horizontal lines of the analog display screen, the total number of pixels (HTOTAL) in each line is typically more than the source image width. For example, for the alphanumeric mode of the VGA standard, HTOTAL equals 900 pixels even though the source image width is 720. Similarly, VTOTAL representing the number of vertical lines in each frame is more than the source image height to allow for vertical retrace.

In general, a digital display unit needs to sample a received analog display signal to recover the pixel data elements from which the display signal was generated. For accurate recovery, the number of samples taken in each horizontal line needs to equal HTOTAL. Each horizontal line is usually identified by successive horizontal synchronization pulses. If the number of samples taken is not equal to HTOTAL, the sampling may be inaccurate and display artifacts may results as described with reference to FIG. 1.

FIG. 1 is a diagram of the amplitude of a display signal as a function of time illustrating typical characteristics of analog display signals. Typically, a display signal portion for each pixel data element has a settling period (shown as 110-A and 110-B) before the steady-state (150-A and 150-B respectively) is reached. The steady-state represents the value (e.g., color intensity) of the pixel data element in a source image. For an accurate reproduction of the source image pixel data values, a digital display unit needs to sample a received display signal during a steady-state. Hence, a digital display unit may need to sample each horizontal line of a received display signal a number of times equal to HTOTAL.

Therefore, a digital display unit typically needs the HTOTAL for accurate sampling of the received analog display signal. There are other display signal parameters which a digital display unit may need for accurate sampling of a received display signal. The number of colors, the horizontal start position (representing the pixel number in each horizontal line from which the source image data starts) and vertical start position (representing the line number from which the source image data starts) are examples of some of the other display signal parameters.

From the above description, it should be appreciated that a digital display unit often needs to determine a source mode in which a received analog display signal is generated. Often, a digital display unit measures some of display signal parameters (which can be readily measured), and determines others according to pre-set configurations. For example, a digital display unit may store a table (or any other data structure) with the display signal parameter values associated with each of a predetermined set of potential source modes. Some of the signal parameters such as VTOTAL, synchronization signal polarities, the time for receiving each horizontal line may be measured. One or more of these measured parameter values is compared with corresponding parameter values of a potential source mode. Once a match is detected in the comparison, the signal is determined to have been generated according to the corresponding source mode.

Many parameter values of a source mode are often defined by standards (e.g., VGA, SVGA) and the pre-stored values generally correspond to such values defined by the standards. However, the measured values can differ at least in minor respects from the pre-stored values. For example, given the same standard for a source mode, different manufacturers can implement the standard with slightly different display signal parameter values. Further variations may be introduced due to manufacturing imperfections.

In addition, the physical characteristics of the hardware (e.g., clock or DAC) at a graphics source can drift with the ambient temperature and the age of the display unit, leading to further variations from the pre-stored values. Furthermore, some digital display units may employ discrete measurement techniques to measure the source parameters. For example, the time for receiving a horizontal line may be measured in terms of the number of pulses (or periods) of a clock employed in a display unit. Assuming a 10 MHZ clock is employed, the measurement error can be as high as 200 nano-seconds.

Due to the deviation generally to be expected in the measured display signal parameter values from the pre-stored display signal parameter values, a digital display unit may associate a tolerance level with each display signal parameters. If the computed difference of a measured value and a pre-stored value is withing the tolerance level, a match may be deemed to exist.

In general, a large tolerance value leads to a determination of an incorrect match (or determination of more than one match). As a result, a source mode with substantially different display signal parameter values may be selected, and the images encoded in a received display signal may not be accurately displayed. On the other hand, if the tolerance level is too small, even if an acceptable source mode having insubstantial deviation of values is pre-stored in a digital display unit, the acceptable mode may not be selected.

Therefore, what is needed is a method and apparatus which enables a digital display unit to accurately determine an optimal source mode in the presence of deviations of source mode parameter values from any pre-stored values associated with the pre-stored modes.

SUMMARY OF THE INVENTION

The present invention is directed to a digital display unit, which may accurately determine a source mode using which a received analog display signal was generated. The accurate determination of the source mode generally enables the display unit to correctly reproduce (or display) the images encoded in the received display signal.

To determine the source mode, a digital display unit may measure some of the display signal parameters by examining the display signal. The measured values may be compared with corresponding pre-stored parameter signal values associated with potential (pre-stored) source modes. Associated with each display signal parameter is also a tolerance level. If the difference of the measured value and a pre-stored parameter value are within the tolerance level, a match may be deemed to exist with respect to the display signal parameter.

A digital display unit in accordance with the present invention varies the tolerance level adaptively. For example, if multiple matches are detected with respect to a display signal parameter, the tolerance level may be decreased. On the other hand, if no source mode is determined to be matching, the tolerance level may be increased. Due to such adaptive variations in the tolerance levels, the present invention enables a source mode to be identified accurately.

A maximum tolerance level and a minimum tolerance level (potentially equal to zero) may be associated with each display signal parameter. The maximum tolerance level can be used to ensure that a stored value with substantial variation from the measured value will not be deemed to be matching. The minimum tolerance level can be used to select more than one matching mode if the modes vary from the measured value in insubstantial amounts. In general, a stored mode can be selected based on a determination of the matches determined for the individual signal parameters.

Therefore, the present invention enables the accurate detection of the source mode using which an analog display signal is generated by adaptively varying the tolerance level associated with individual display signal parameters.

The present invention enables more than one source mode to be determined to be matching while allowing accurate detection of the matching source mode. This feature is accomplished by using a minimum threshold with each display signal parameter and determining that multiple matches exist if more than one stored value is within the minimum threshold of the measured value.

The present invention ensures that a match is not detected when the stored display signal values vary in substantial respects from the measured values. This is accomplished by associating a maximum tolerance level with each display signal parameter and ensuring that the tolerance level is not varied to increase above the maximum level while determining a match.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE DRAWINGS

The present invention will be described with reference to the accompanying drawings, wherein.

DETAILED DESCRIPTION OF THE PREFERRED EMBODIMENTS

1. Overview and Discussion of the Invention

In accordance with the present invention, some of the display signal parameter values associated with received analog display signal are measured and compared with corresponding pre-stored parameter values associated with individual source modes. During the comparison, a tolerance level is associated with each compared parameter. In general, a display signal parameter value of a source mode is considered to match a corresponding measured value if the difference of the stored value and the corresponding measured value is within the corresponding tolerance level. A source mode is typically considered to be appropriate for processing the received display signal if a match exists for some or all of the parameter values for the source mode.

If a match is not detected for a parameter or if a matching source mode is not found, the tolerance levels are adaptively changed (varied) until a suitable source mode is determined. As an illustration, if more than one source mode is determined to be suitable based on the comparison, the tolerance levels are decreased. On the other hand, if no source mode is determined to be suitable based on the comparison, the tolerance levels are increased. Thus, the present invention enables one of the pre-stored source modes to be selected accurately by adaptively changing the tolerance levels used for detecting parameter matches.

The present invention is described below in further detail with reference to one or more example embodiments. First, an example environment in which the present invention can be used is described. Next, general methods for implementing the present invention are described. Then, a digital display unit implementing the present invention is described.

2. Example Environment

In a broad sense, the invention can be implemented in any computer system having a digital display unit such as a flat panel monitor. The present invention is described in the context of a computer system operating in graphics modes such as EGA, VGA and SVGA modes. Such computer systems include, without limitation, lap-top and desk-top personal computer systems, work-stations, special purpose computer systems, general purpose computer systems, network computers, and many others. The invention may be implemented in hardware, software, firmware, or combination of the like. The above noted graphics modes are described in detail in a book entitled, "Programmer's Guide to the EGA, VGA, and Super VGA Cards", published by Addition-Wesley Publishing Company, by Richard F. Ferraro, ISBN Number 0-201-62490-7, which is incorporated in its entirety herewith.

Figure 1:
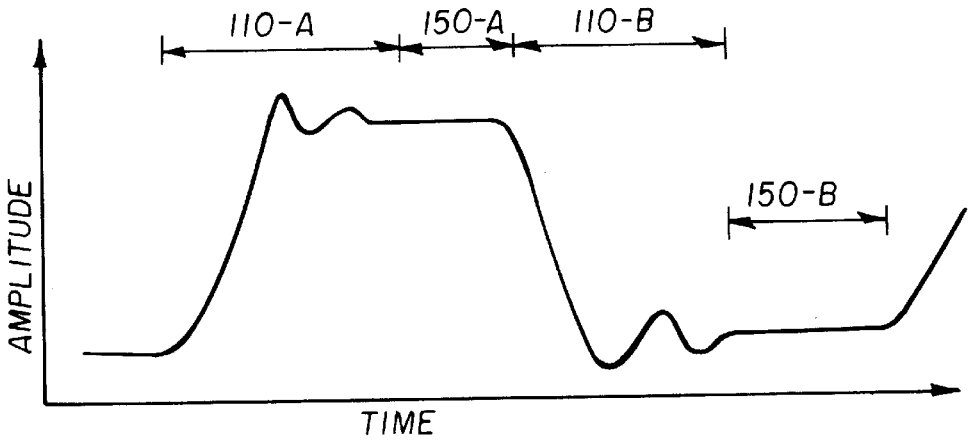
FIG. 1 (Prior Art)
FIG. 1 is a diagram of an analog display signal as a function of time illustrating the stable and settling portions of the signal when generated from pixel data elements.
Figure 2:
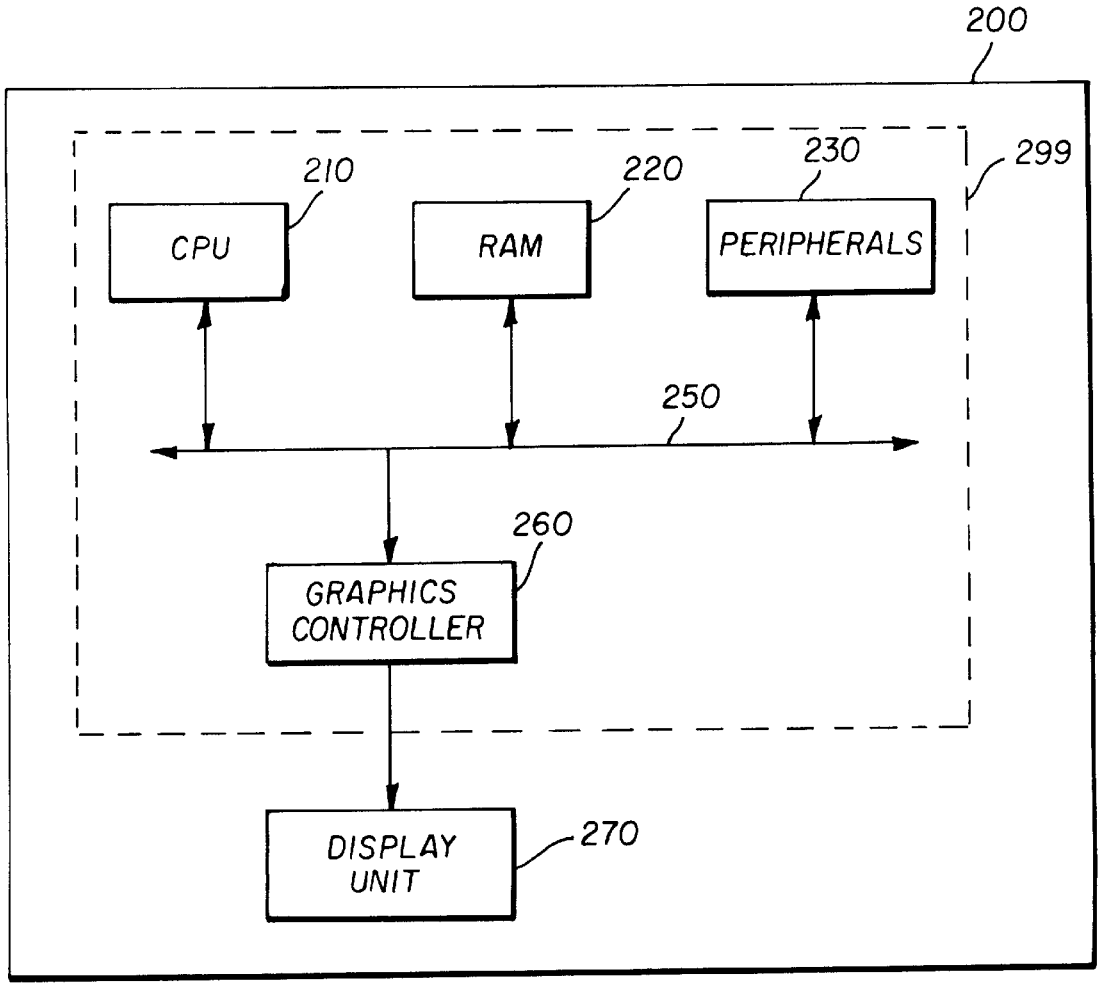
FIG. 2 is a block diagram of a computer system illustrating an example environment for implementing the present invention.

FIG. 2 is a block diagram of computer system 200 in which the present invention can be implemented. Computer system 200 includes central processing unit (CPU) 210, random access memory (RAM) 220, one or more peripherals 230, graphics controller 260, and digital display unit 270. CPU 210, RAM 220 and graphics controller 260 are typically packaged in a single unit, and such a unit is referred to as graphics source 299 as the display signal is generated by the unit. All the components in graphics source 299 of computer system 200 communicate over bus 250, which can in reality include several physical buses connected by appropriate interfaces.

RAM 220 stores data representing commands and possibly pixel data representing a source image. CPU 210 executes commands stored in RAM 220, and causes different commands and pixel data to be transferred to graphics controller 260. Peripherals 230 can include storage components such as hard-drives or removable drives (e.g., floppy-drives). Peripherals 230 can be used to store commands and/or data which enable computer system 200 to operate in accordance with the present invention. By executing the stored commands, CPU 210 provides the electrical and control signals to coordinate and control the operation of various components.

Graphics controller 260 receives data/commands from CPU 210, generates analog display signals including display data and corresponding synchronization signals, and provides both to display unit 270. Graphics controller 260 can generate an analog display signal in the RS-170 standard with RGB signals. It should be further understood that the present invention can be implemented with analog image data and/or reference signals in other standards even though the present description is provided with reference to RGB signals. Examples of such standards include composite sync standard usually implemented on Macintosh Computer Systems and Sync on Green standard.

In general, graphics controller 260 first generates pixel data elements of a source image with a predefined width and height (measured in terms of number of pixel data elements) determined by a source mode. The pixel data elements for a source image may either be provided by CPU 210 or be generated by graphics controller 260 in response to commands from CPU 210.

The source mode is typically determined based on a combination of user configuration (which specifies the general standard of the source mode) and the manufacturer implementing the graphics controller 260. As noted in the section entitled "Background of the Invention", different manufacturers can implement different standards with slight variations in the display signal parameters. The source mode typically specifies several display signal parameters including the width, height, HTOTAL, VTOTAL, refresh rate, color depth (number of bits to represent each color) etc.

Graphics controller 260 generates a display signal based on the pixel data elements according to the display signal parameters of the source mode. The display signal is generally generated by using a digital-to-analog converter (DAC), which converts each pixel data element (specifying a color intensity) into a corresponding display signal portion. In one embodiment, the analog display signal is in the form of RGB signals and the reference signal includes the VSYNC and HSYNC signals well known in the art and explained in detail below. Therefore, three analog display signals (red, green and blue) are generated from each pixel data element. For conciseness, the present invention is described with reference to one display data signal. It should be understood that the description may be applicable to all the three display data signals.

Digital display unit 270 receives an analog display signal from graphics controller 260, and processes the received display signal based upon a determination of a source mode. The source mode is defined by various display signal parameters (such as frequency, the pixel position from which the pixel data elements forming an image are assumed to be present). Display unit 270 may include a table (or other data structure) to store the display signal parameter values associated with each of a set of modes (pre-stored or pre-defined modes).

Display unit 270 typically measures some of the parameters by examining the received signal and attempts to determine the correct one of the stored source modes. Once the source mode is determined, the stored parameter values associated with the source mode are used to process the analog display signal. Processing a signal generally entails recovering the image data encoded in the received display signal and generating appropriate signals to display the images on a display screen (panel) included in the digital display unit. The manner in which the source mode can be determined in accordance with the present invention is described in further detail below with reference to FIGS. 3, 4 and 5.

3. Method of the Present Invention

Figure 3:
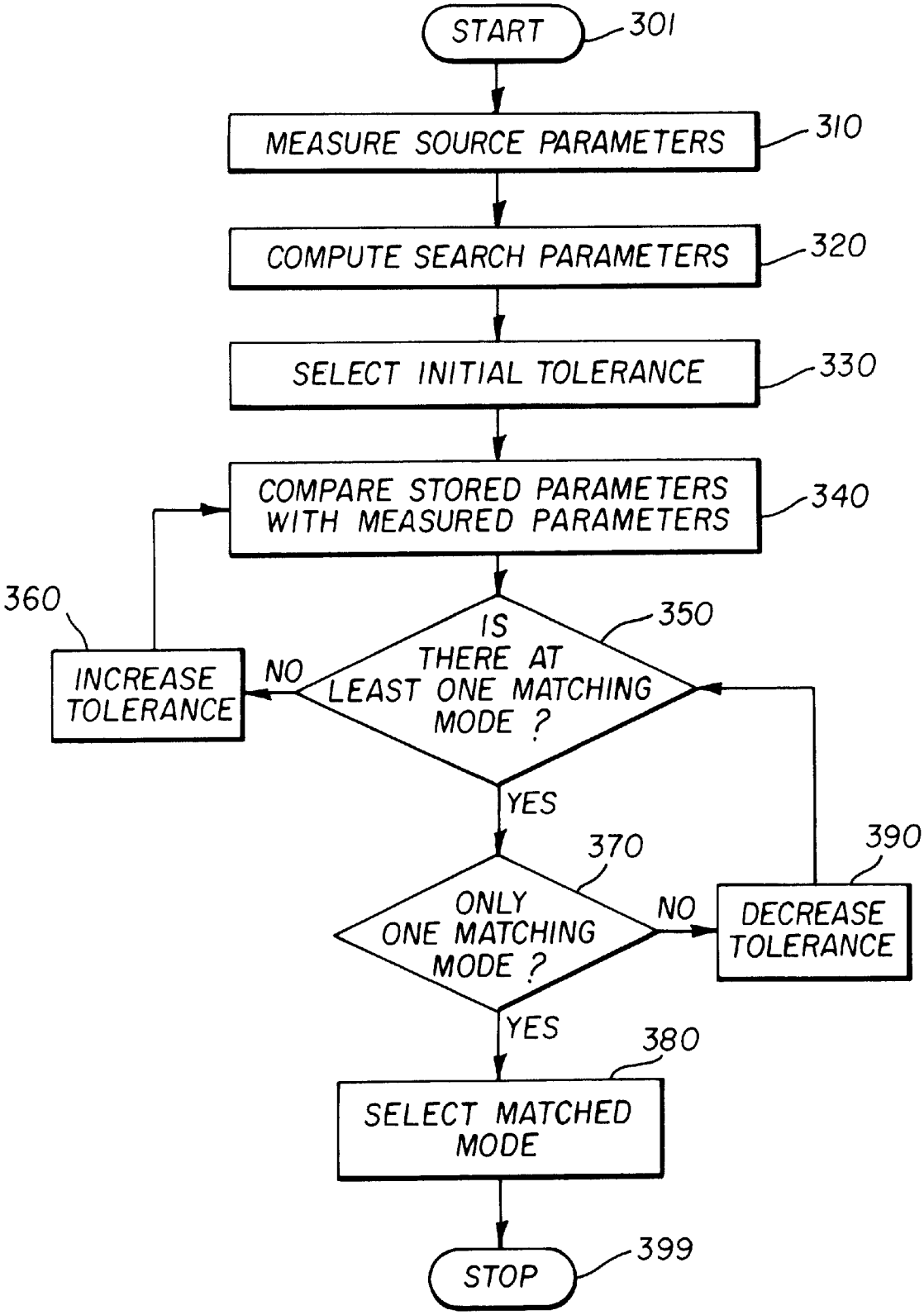
FIG. 3 depicts a flow-chart illustrating the manner in which the tolerance levels for determining a mode match can varied dynamically in accordance with the present invention while determining a suitable source mode match.

FIG. 3 is a flow-chart illustrating a method in accordance with the present invention. For illustration, the method is described with reference to FIG. 2. In step 310, display unit 270 measures the source parameters of a received analog display signal to generate the corresponding source parameter values. Typically, timing parameters such as VTOTAL, the time duration required to receive a horizontal line, horizontal synchronization signal width, horizontal synchronization signal front and back porches, vertical synchronization signal width, vertical synchronization signal front and back porches, synchronization signal polarities may be measured in a known way.

The measured set of values can be used to select (determine) the appropriate source mode. In step 320, any search parameters required for accessing pre-stored values for the source mode can be computed. The access and computations may be performed in a known way. In step 330, a tolerance level is selected for each of the display signal parameters to be used for comparison in determining the correct source mode. The tolerance level can be any number (positive, negative or range). As an illustration, a single number X can be used to specify a range, and match may be said to be found if a measured value (M) is greater than (S−X) and less than (S+X), wherein S represents the stored parameter value. In general, any convention can be used to determine to determine whether the difference of stored and measured parameters are within the tolerance level.

In an embodiment, some of the parameters such as those associated with horizontal timing (i.e., horizontal synchronization signal front and back porches, width, time duration for receiving a horizontal line) may be measured in terms of the number of clock pulses. In such a situation, the tolerance of all such parameters may be expressed in terms of the number of clock periods. However, it should be understood that tolerance levels disproportionate to the clock period can be associated with individual parameters used for comparison.

The remaining flow-chart includes loops to select the appropriate source mode for processing the received analog display signal. The loops can be implemented in several ways as would be apparent to one skilled in the relevant arts. An example set of steps to implement the loop are described below. Ideally, the loops need to determine a single source mode to process the analog display signal. However, some times more than one source mode may be found to match and in other cases, no match may be detected. The present invention enables a single suitable mode to be selected in either case by adaptively changing the tolerances levels as illustrated herein.

The loop of 340, 350 and 360 operates to detect at least one potential matching mode by adaptively increasing the tolerance levels if a matching mode is not found. In step 340, the measured parameter values (of step 310) are compared with corresponding parameter values of each source mode stored in the table. In step 350, the digital display unit determines whether there is at least one matching mode. A mode may be found to be matching if all the measured parameter values match the corresponding stored parameter values associated with the mode. A match for an individual parameter may be determined, for example, as described with reference to step 330.

If at least one matching mode is determined to have been not found, the tolerance level is increased in step 360. The tolerance level for each parameter can be increased by different proportions or different values. However, in one embodiment which measures some of the parameter values in terms of number of clock periods, the tolerance level for all such parameters is increased proportionately.

The tolerance level may be increased by large proportions (e.g., 50%) to ensure a faster detection of potential matching modes in steps 340 and 350. Well known techniques such as binary search, successive approximation may be employed for a speedy determination of the appropriate source mode. Large increases can lead to detection of multiple potential matching modes in step 350. Should the matching of a lot of modes be undesirable, the tolerance levels can be increased in smaller proportions. Due to the feature of increasing the tolerance levels, the initial tolerance of step 330 can be chosen to be fairly low to be able to distinguish between modes varying in parameter values by fairly small amounts.

If more than one matching mode is found to exist, steps 370 and 380 operate to select one matching mode. A single mode may be selected in one of several ways. For example, in step 370, a digital display unit may determine if there is a display signal parameter which has only one matching mode. In a more computationally intensive scheme, a digital display unit may determine if there exists only one source mode which has been matched for all compared parameters. If a single matching mode exists, the mode may be selected for processing the analog display signal.

If selection of one matching mode is not possible according to steps 370 and 380, the tolerance level is decreased for the compared parameters in step 390 and control goes to step 340 for comparison with the new tolerance levels chosen. The degree of decrease of tolerance levels need to take into account the desired speed with which detection of a single mode is to be performed (in which case the decreases should be more), and the accurate detection of just a single mode (in which case the decreases should be less). The steps of 340, 350, 360, 370 and 390 may be performed at least until one matching mode is present.

Thus, the method of FIG. 3 can be used to determine the source mode using which a received display signal was generated. The source mode can be determined accurately as the tolerance levels are changed adaptively depending on whether no modes are matched or more than one mode is matched. Several implementations according to the method of FIG. 3 will be apparent to one skilled in the relevant arts.

Typical implementations may need to include an upper limit to the tolerance levels to ensure that a source mode with unacceptably different parameters may not be selected. Similarly, a lower limit to the tolerance levels may also need to be implemented so that more than one source mode can be determined to be acceptable for processing the display signal. A user may then be provided the capability to select among the acceptable modes as described, for example, in the co-pending U.S. patent application entitled "Digital Display Unit in a Computer System for Enabling a User to Conveniently Select a Desired Monitor mode for Displaying Images Encoded in a Received Analog Display Signal", Ser. No. 09/02,3815, filed Feb. 13, 1998, attorney docket number PRDS-0008, and is incorporated in its entirety into the present application herewith.

4. Another Method According to the Present Invention

Figure 4:
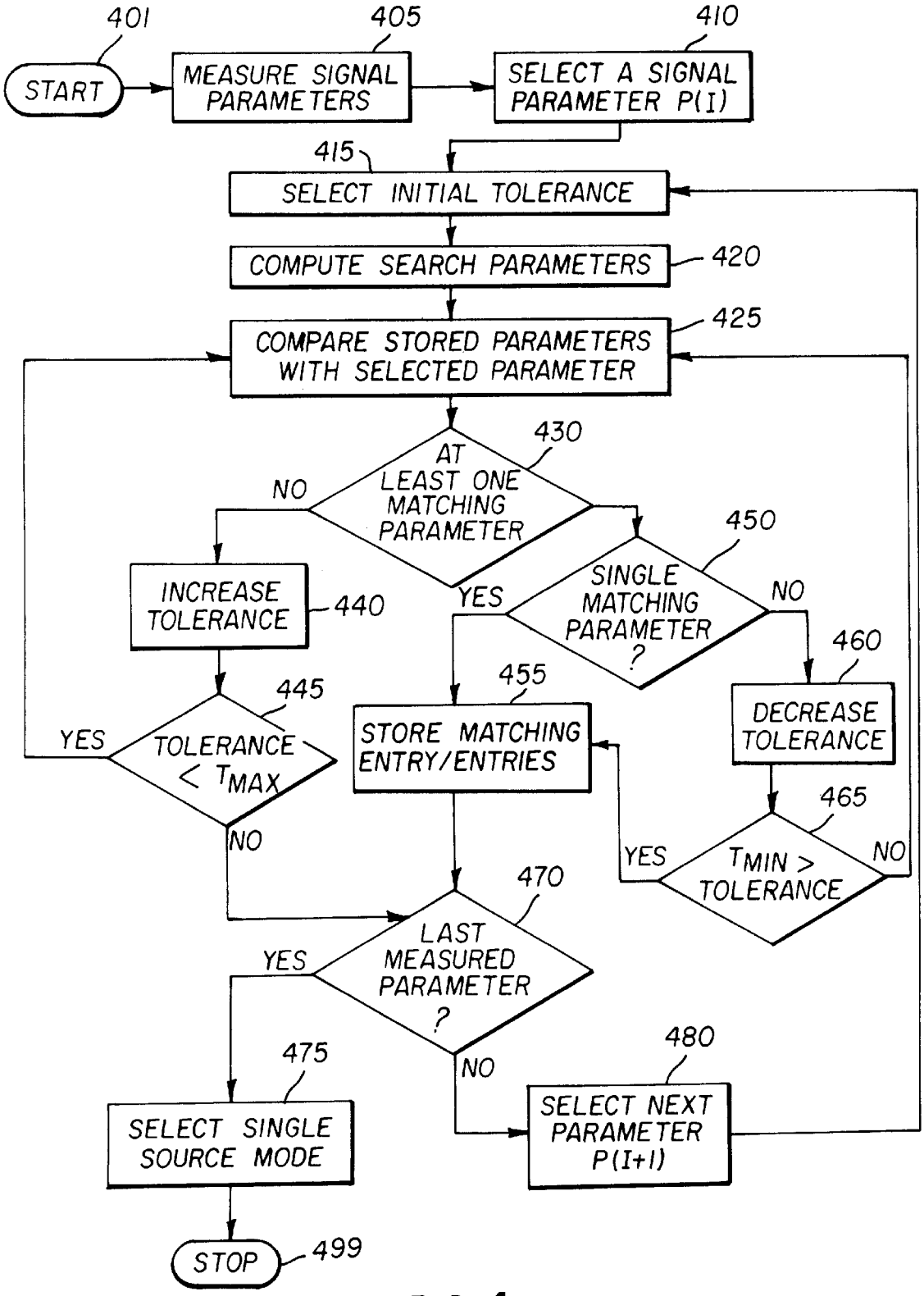
FIG. 4 depicts another flow-chart illustrating the manner in which the tolerance levels for determining a mode match can varied dynamically in accordance with the present invention while determining a suitable source mode match.

FIG. 4 is a flow-chart illustrating another method according to the present invention. The method here differs from that of FIG. 3 in that the closest matching modes may be determined for each measured display signal parameter, and one of the matching source modes is selected according to various criteria described below. On the other hand, the flow-chart of FIG. 4 may compute deviations with respect to all or several measured parameters for each mode in determining whether the corresponding mode is suitable for processing the display signal as described below.

In step 405, the display signal parameter values used for comparison may be measured in a known way. In step 410, a first display signal parameter (i=0) is chosen for comparison. In step 415, an initial tolerance level associated with the chosen signal parameter is selected. The initial tolerance level, along with maximum ($T_{max}$) and minimum ($T_{min}$) tolerance levels (described below), can be pre-specified by a user. In step 420, a search key may be computed as in step 320 of FIG. 3 to minimize the number of source modes compared while determining a single suitable mode.

Steps 425, 430, 440 and 445 operate to select at least one source mode which is within an acceptable tolerance level for the chosen display signal parameter. In step 425, the measured value is compared to a pre-stored value for the chosen parameter. The comparison is performed with respect to all stored potential modes (or more specifically, those limited by using the search key—entry tag mechanism).

In step 430, a determination is made as to whether there is at least one matching mode with respect to the chosen parameter. As noted above with reference to step 320, a match may be determined to be found if a measured value (M) is greater than (S−X) and less than (S+X), wherein S represents the stored parameter value, S represents the stored parameter value and X represents tolerance level for the present iteration.

If no matching mode is detected in step 430, the tolerance level may be increased. As noted with reference to step 360 of FIG. 3, the increases can be large for a faster convergence in determining closest matching modes and small to avoid finding more than one matching mode. One can start with a fairly small tolerance value and the tolerance level can be increased by as much as 50% each time when step 440 is executed.

Control passes to comparisons of step 425 if the tolerance level is within an acceptable range. Therefore, the tolerance level computed in step 440 may be compared with a maximum tolerance level $T_{max}$ in step 445 and control passes to step 445 only if the tolerance level is less than $T_{max}$. Otherwise control may pass to step 470 described below.

Steps 425 and 430 described above, and steps 450, 460 and 465 operate to increase the tolerance level until the closest matching mode is determined for the chosen display signal parameter. The tolerance level associated with the chosen display signal parameter is decreased in step 460. The decrement operation may be performed as in step 390 of FIG. 3. If the tolerance level is above $T_{min}$, control passes to step 425. $T_{min}$ can equal as low as zero. However, modes with fairly insignificant variation may be determined to match to minimize the number of loops, and accordingly $T_{min}$ may be chosen to be a small number.

Step 455 is executed either if a single match is detected for a parameter upon comparison with parameter values of all modes or if more than one mode has parameter signal values within the $T_{min}$ tolerance values. In step 455, all the modes having stored parameter signal value within $T_{min}$ tolerance of the chosen measured value are stored associated with the chosen parameter. In step 470, a determination is made as to whether the chosen parameter processed during the present iteration is the last parameter. If more parameters exist, the next parameter is chosen as the parameter for the next iteration in step 480 and control passes to step 415.

A single source mode is selected in step 475 according to a pre-determined convention by examining the matching entries stored in step 455. The stored entries together may represent one of four situations (1) One source mode includes all matching parameters, (2) more than one source mode includes all matching parameters, (3) no mode includes all matching parameters, but there are several matched parameter from among several modes, and (4) there are no matching parameters.

In case (1), the matched mode is selected to process the analog display signal according to one pre-determined convention. In case (2), any one of the source modes may be selected to process the analog display signal. A user may be provided the ability to select from other modes, for example, as described in the co-pending U.S. patent application entitled "Digital Display Unit in a Computer System for Enabling a User to Conveniently Select a Desired Monitor mode for Displaying Images Encoded in a Received Analog Display Signal", Ser. No. 09/02,3815, filed Feb. 13, 1998, attorney docket number PRDS-0008, and is incorporated in its entirety into the present application herewith. Each of the matched source modes may correspond to a monitor mode of the related application.

In case (3), one of the source modes with a maximum number of matching parameters may be selected to process the signal. In the alternative, a weight may be assigned with each compared parameter and the mode having the aggregate weighted average of the matched parameters may be selected. A user may again be provided the option to switch to use a different source mode, again as in the related application noted above. Once all the modes with at least one matching parameter are used to process and display the analog display signal, and the user wishes to change the source mode, a digital display unit may resort to display signal parameters estimation in a known way and define a new mode. A new mode may need to be defined even in case (4) of above.

Thus, the present invention enables a correct source mode to be selected for displaying images encoded in an analog display signal. As a tolerance level is varied adaptively until a single source mode is preferably found, the present invention may allow the correct source mode to be detected to process an analog display signal. At least using the above-described methods, several digital display units can be implemented. An example digital display unit implemented in accordance with the present invention is described below with reference to FIG. 5.

5. An Embodiment of Digital Display Unit

Figure 5:
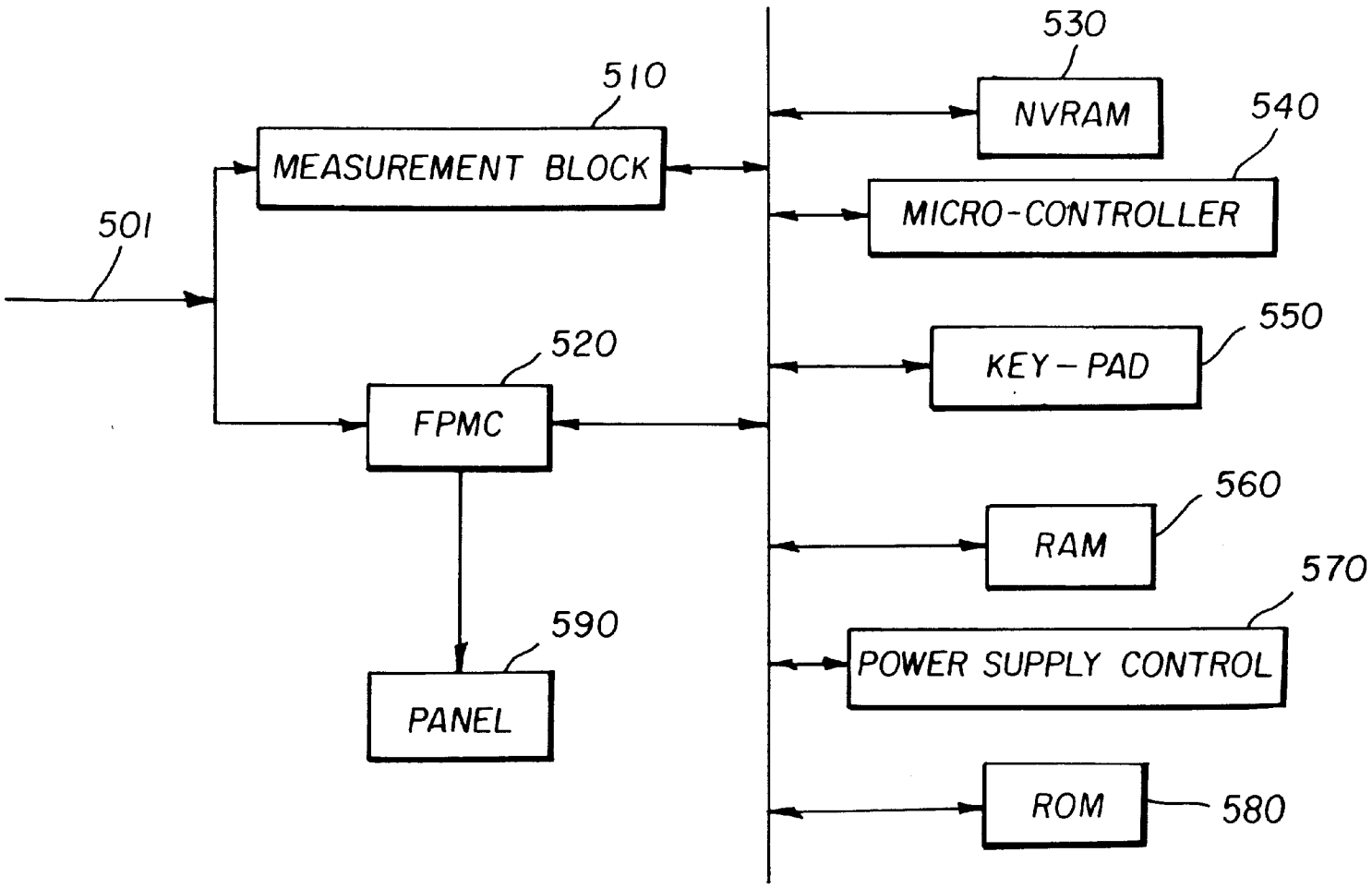
FIG. 5 is a block diagram of a digital display unit illustrating an embodiment of the present invention.

FIG. 5 is a block diagram of digital display unit 270 illustrating an embodiment in accordance with the present invention. Digital display unit 270 can include measurement block 510, flat panel monitor controller 520, non-volatile random access memory (NVRAM) 530, micro-controller 540, key-pad 550, random access memory (RAM) 560, power supply 570, read-only-memory (ROM) 580, and display screen 590.

The source modes and corresponding parameter values can be stored in different memories or in a memory. In the embodiment of FIG. 5, non-volatile random access memory NVRAM 530 may be used to store the parameter values. Most source modes are typically pre-defined based on standards or manufacturer specifications. However, new source modes can be defined and added at least to accommodate new graphics controller circuits (shown as 260 of FIG. 2). When multiple source modes have the same values for the measured display signal parameters, each source mode may be termed as a monitor mode and different monitor modes may have different values for other parameter values.

Measurement block 510 receives an analog display signal on line 501, and measures some of the display signal parameters used for determining a suitable source mode. The parameters can be measured in a known way. For example, timing parameters such as the refresh rate, the VTOTAL, synchronization signals polarity, the duration of the synchronization signals, and the horizontal line period, which can be easily determined, are measured. Measurement block 510 sends the measured signal parameters on local bus 599.

A processor such as micro-controller 540 receives the measured display signal parameters and determines a suitable source mode for processing the display signal, for example, as described above in relation to the flow-charts of FIGS. 3 and/or 4. Micro-controller 540 can retrieve the pre-stored parameter values from NVRAM 540 for comparing with the measured values. Micro-controller 540 can be connected to NVRAM 540 by any suitable memory interface. Once a suitable source mode is determined, micro-controller 540 retrieves all the source mode parameters from NVRAM 530, and sets up various components to process the analog display signal to be received on input line 501.

In an embodiment, the display screen comprises flat-panel 590. Flat-panel 590 includes several pixels which are actuated to generate the display of an image. Flat panel monitor controller 520 provides the signals to actuate the individual pixels as described below. Flat panel monitor controller (FPMC) 520 receives the monitor parameters corresponding to a determined mode and processes the analog display signal to generate signals for displaying images on flat panel 590. For example, FPMC 520 receives HTOTAL, VTOTAL and refresh rate to determine the frequency at which to sample the display data included in the analog display data signal.

FPMC 520 can also receive the source image width and height, and the start positions, which enable a determination of the sampled values forming an image to be displayed. FPMC 520 can perform any upscaling or downscaling necessary to display the image at a desired size. FPMC sends signals to panel 590 to display the images encoded in the received display signal.

Power supply control 570 controls the supply of electrical power to all components of display unit 270. ROM 580 stores any data which may need to be stored without modification. For example, a default set of monitors modes can be stored. In contrast, NVRAM 530 can store all display modes including the changed parameter values for any modes. In addition, ROM 580 can store any software code for micro-controller 540 to execute. The software code can control the operation of the overall display unit 270.

Thus, display unit 270 may accurately determine the source mode using which an analog display signal is generated and process the analog display signal according to the determined mode. An accurate determination of the source mode enable the encoded images to be displayed accurately on a display screen in accordance with the present invention.

6. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method of displaying a plurality of images on a digital display unit of a computer system, wherein said plurality of images are encoded in an analog display signal using one of a plurality of source modes, wherein each of said plurality of source modes are characterized by a plurality of display signal parameters, said method comprising the steps of:

(a) storing a plurality of display signal parameter values for each of said plurality of source modes, wherein said plurality of display signal parameter values correspond to said plurality of display signal parameters;

(b) storing a tolerance level associated with each of said display signal parameters;

(c) receiving said analog display signal in said digital display unit;

(d) measuring one or more of said display signal parameters of said received analog display signal to generate a plurality of measured display signal parameter values;

(e) comparing each of said plurality of measured display signal parameter values generated in step (d) with a corresponding one of said display signal parameter values stored in step (a) to generate a corresponding difference value;

(f) determining whether each of said difference values computed in step (e) for each display signal parameter is less than said associated tolerance level;

(g) determining whether there is a matching source mode, wherein a source mode is determined to be matching if said difference for some or all of said plurality of display signal parameters is determined to be within said associated tolerance level in step (f); and (h) varying said tolerance levels and performing steps (e), (f) and (g) if a single source mode is not determined to be matched or if more than a single source mode is determined to be matched until a single source mode is determined to be matched; and (i) processing said analog display signal using said determined single source mode to display said plurality of images encoded in said analog display signal.

2. The method of claim 1, wherein step (h) comprises the steps of:

(j) decreasing said tolerance level for at least some of said display signal parameters if more than one single source mode is determined to be matched in step (g); and (k) increasing said tolerance level for at least some of said display signal parameters if no source mode is determined to be matching in step (g).

3. The method of claim 2, further comprising the step of providing a minimum tolerance level, wherein said (j) is performed until said tolerance level is less than or equal to said minimum tolerance level.

4. The method of claim 2, further comprising the step of providing a maximum tolerance level, wherein said (k) is performed until said tolerance level is greater than or equal to said maximum tolerance level.

5. The method of claim 1, further comprising the step of:

(m) determining a plurality of matching modes with respect to each of said display signal parameters, wherein a mode is matching with respect to a display signal parameter if said difference for the mode is determined to be less than said associated tolerance level in step (f);

(n) determining said single source mode to be a source mode matching with respect to all display signal parameters; and (o) determining said single source mode to be a source mode matching with respect to a maximum number of display signal parameters if no mode is determined to be said single matching mode in step (n).

6. The method of claim 1, wherein said analog display signal comprises one of red, blue or green signals.

7. A method of displaying a plurality of images on a digital display unit of a computer system, wherein said plurality of images are encoded in an analog display signal using one of a plurality of source modes, wherein each of said plurality of source modes are characterized by a plurality of display signal parameters, said method comprising the steps of:

(a) storing a plurality of display signal parameter values for each of said plurality of source modes, wherein said plurality of display signal parameter values correspond to said plurality of display signal parameters;

(b) storing a minimum tolerance level and a maximum tolerance level associated with each of said display signal parameters;

(c) receiving said analog display signal in said digital display unit;

(d) measuring a first display signal parameter of said received analog display signal to generate a measured display signal parameter value, wherein said first display signal parameter is included in said plurality of display signal parameters;

(e) comparing said measured display signal parameter value generated in step (d) with each of corresponding display signal parameter values stored in step (a) to generate a corresponding difference value;

(f) determining whether each of said difference values computed in step (e) is less than an associated tolerance level;

(g) determining source modes with matching parameter, wherein a source mode is determined to be matching if the corresponding difference value is determined to be within said associated tolerance level; and (h) varying said tolerance level between said maximum tolerance level and said minimum tolerance level associated with said first parameter and performing steps (e), (f) and (g) to determine source modes with matching parameter values for said first parameter;

(i) repeating steps (d)–(h) while selecting each of said display signal parameters as said first parameter to determine associated matching source modes for each of said selected display signal parameter;

(j) selecting a single source mode from said matching source modes of steps (h) and (i) according to a predetermined convention; and (k) processing said analog display signal using said single source mode to display said plurality of images encoded in said analog display signal.

8. A digital display unit for displaying a plurality of images, wherein said plurality of images are encoded in an analog display signal using one of a plurality of source modes, wherein each of said plurality of source modes are characterized by a plurality of display signal parameters, said digital display unit comprising:

a non-volatile memory for storing a plurality of display signal parameter values for each of said plurality of source modes, wherein said plurality of display signal parameter values correspond to said plurality of display signal parameters;

a measurement block for measuring said one or more of said display signal parameters of said received analog display signal to generate a plurality of measured display signal parameter values;

a processor for comparing each of said measured display signal parameter values with a corresponding one of said stored display signal parameter values to generate a corresponding difference value, said processor determining whether each of said difference values is within an associated tolerance level to determine whether there is a matching source mode, wherein a source mode is determined to be matching if said difference for some or all of said plurality of display signal parameters is determined to be less than said associated tolerance level, and wherein said processor varies said tolerance levels if a single source mode is not determined to be matched or if more than a single source mode is determined to be matched until a single source mode is determined to be matched;

a display screen for displaying images; and a controller for processing said analog display signal using said determined single source mode to display said plurality of images encoded in said analog display signal on said display screen.

9. The digital display unit claim 8, wherein said processor is designed to decrease said tolerance level for at least some of said display signal parameters if more than one single source mode is determined to be matched, and to increase said tolerance level for at least some of said display signal parameters if no source mode is determined to be matched.

10. The digital display unit claim 9, wherein said non-volatile memory is designed to store a minimum tolerance level, and wherein said processor decreases said tolerance level until said tolerance level is less than or equal to said minimum tolerance level.

11. The digital display unit of claim 9, wherein said non-volatile memory is designed to store a maximum tolerance level, and wherein said processor increases said tolerance level until said tolerance level is greater than or equal to said maximum tolerance level.

12. The digital display unit of claim 9, wherein said processor determines a plurality of matching modes with respect to each of said display signal parameters, wherein a mode is matching with respect to a display signal parameter if said difference for the mode is determined to be less than said associated tolerance level, said processor determining said single source mode to be a source mode matching with respect to all measured display signal parameters, and said processor determining said single source mode to be a source mode matching with respect to a maximum number of display signal parameters if no mode is determined to be said single matching mode.

13. A circuit for displaying a plurality of images on a display screen of a digital display unit, wherein said plurality of images are encoded in an analog display signal using one of a plurality of source modes, wherein each of said plurality of source modes are characterized by a plurality of display signal parameters, said digital display unit comprising:

an interface to a memory which stores a plurality of display signal parameter values for each of said plurality of source modes, wherein said plurality of display signal parameter values correspond to said plurality of display signal parameters;

a measurement block for measuring said one or more of said display signal parameters of said received analog display signal to generate a plurality of measured display signal parameter values;

a processor coupled to said interface and said measurement block, said processor for comparing each of said measured display signal parameter values with a corresponding one of said stored display signal parameter values to generate a difference value, said processor determining whether each of said difference values is within an associated tolerance level to determine whether there is a matching source mode, wherein a source mode is determined to be matching if said difference for each of said plurality of display signal parameters is determined to be within said associated tolerance level, and wherein said processor is designed to vary said tolerance levels if a single source mode is not determined to be matched or if more than a single source mode is determined to be matched until a single source mode is determined to be matched, and wherein a display controller processes said analog display signal using said single source mode display said plurality of images encoded in said analog display signal on a display screen.

14. The circuit claim 13, wherein said processor is designed to decrease said tolerance level for at least some of said display signal parameters if more than one single source mode is determined to be matched, and to increase said tolerance level for at least some of said display signal parameters if no source mode is determined to be matched.

15. The circuit claim 13, wherein said non-volatile memory is designed to store a minimum tolerance level, and wherein said processor decreases said tolerance level until said tolerance level is less than or equal to said minimum tolerance level.

16. The circuit of claim 14, wherein said non-volatile memory is designed to store a maximum tolerance level, and wherein said processor increases said tolerance level until said tolerance level is greater than or equal to said maximum tolerance level.

17. The circuit of claim 15, wherein said processor determines a plurality of matching modes with respect to each of said display signal parameters, wherein a mode is matching with respect to a display signal parameter if said difference for the mode is determined to be less than said associated tolerance level, said processor determining said single source mode to be a source mode matching with respect to all measured display signal parameters, and said processor determining said single source mode to be a source mode matching with respect to a maximum number of display signal parameters if no mode is determined to be said single matching mode.

18. A digital display unit for displaying a plurality of images, wherein said plurality of images are encoded in an analog display signal using one of a plurality of source modes, wherein each of said plurality of source modes are characterized by a plurality of display signal parameters, said digital display unit comprising:

means for storing a plurality of stored display signal parameter values for each of said plurality of source modes, wherein said plurality of stored display signal parameter values correspond to said plurality of display signal parameters characterizing each of said plurality of source modes;

means for storing a tolerance level associated with each of said display signal parameters;

means for receiving said analog display signal in said digital display unit;

means for measuring said one or more of said display signal parameters of said received analog display signal to generate a plurality of measured display signal parameter values;

means for comparing each of said measured display signal parameter values with a corresponding one of said stored display signal parameter values to generate a difference value;

means for determining whether each of said difference values for each display signal parameter is within said associated tolerance level;

means for determining whether there is a matching source mode, wherein a source mode is determined to be matching if said difference for each of said plurality of display signal parameters is determined to be less than said associated tolerance level; and means for varying said tolerance levels if a single source mode is not determined to be matched or if more than a single source mode is determined to be matched until a single source mode is determined to be matched; and means for processing said analog display signal using said determined single source mode to display said plurality of images encoded in said analog display signal.

19. A digital display unit for displaying a plurality of images, wherein said plurality of images are encoded in an analog display signal using one of a plurality of source modes, wherein each of said plurality of source modes are characterized by a plurality of display signal parameters, said digital display unit comprising:

means for storing a plurality of display signal parameter values for each of said plurality of source modes, wherein said plurality of display signal parameter values correspond to said plurality of display signal parameters;

means for storing a tolerance level, a minimum tolerance level and a maximum tolerance level associated with each of said display signal parameters;

means for receiving said analog display signal in said digital display unit;

means for measuring a first display signal parameter of said received analog display signal to generate a measured display signal parameter value, wherein said first display signal parameter is included in said plurality of display signal parameters;

means for comparing said measured display signal parameter value with each of said corresponding stored display signal parameter values of all stored modes to generate a corresponding difference value;

means for determining whether each of said difference values is less than said associated tolerance level to determine matching source modes associated with said first display signal parameter, wherein a source mode is determined to be matching if corresponding difference value is determined to be within said associated tolerance level; and means for varying said tolerance level between said maximum tolerance level and said minimum tolerance level associated with said first parameter to determine any source modes with matching parameter values for said first parameters;

means for determining associated matching modes for each of said display signal parameters by setting corresponding display signal parameter as said first parameter;

means for selecting a single source mode from said matching source modes associated with each of said display signal parameters; and means for processing said analog display signal using said single source mode to display said plurality of images encoded in said analog display signal.

20. A circuit for displaying a plurality of images on a display screen of a digital display unit, wherein said plurality of images are encoded in an analog display signal using one of a plurality of source modes, wherein each of said plurality of source modes are characterized by a plurality of display signal parameters, said digital display unit comprising:

an interface to a memory which stores a plurality of display signal parameter values for each of said plurality of source modes, wherein said plurality of display signal parameter values correspond to said plurality of display signal parameters;

a measurement block for measuring said one or more of said display signal parameters of said received analog display signal to generate a plurality of measured display signal parameter values;

a processor coupled to said interface and said measurement block, said processor for determining source modes having a matching display signal parameter value with each of said measured display signal parameters by adaptively varying a tolerance level, wherein a source mode is determined to be matching if a difference of the corresponding stored display signal parameter value and said measured display signal is within the tolerance level associated with said display signal parameter, said processor selecting one of the matching modes according to a pre-determined scheme to process said analog display signal to display said plurality of images encoded in said analog display signal on a display screen.

21. The circuit of claim 20, wherein said processor increases said tolerance level if no matching mode is detected for a display signal parameter and decreases said tolerance level if more than one matching mode is detected for a display signal parameter.

22. The circuit of claim 21, wherein said memory stores a minimum tolerance level and a maximum tolerance level associated with each of said display signal parameters, and wherein said processor increases said tolerance level not to exceed said maximum tolerance level and decreases said tolerance level not to fall below said minimum tolerance level.

23. The circuit of claim 20, wherein said predetermined scheme comprises selecting a source mode which has matched with respect to all measured display signal parameters.

24. A digital display unit for displaying a plurality of images, wherein said plurality of images are encoded in an analog display signal using one of a plurality of source modes, wherein each of said plurality of source modes are characterized by a plurality of display signal parameters, said digital display unit comprising:

a non-volatile memory for storing a plurality of display signal parameter values for each of said plurality of source modes, wherein said plurality of display signal parameter values correspond to said plurality of display signal parameters, said non-volatile memory also storing a tolerance level associated with each of said display signal parameters;

a measurement block for measuring said one or more of said display signal parameters of said received analog display signal to generate a plurality of measured display signal parameter values;

a processor coupled to said interface and said measurement block, said processor for determining source modes having a matching display signal parameter value with each of said measured display signal parameters by adaptively varying a tolerance level, wherein a source mode is determined to be matching if a difference of the corresponding stored display signal parameter value and said measured display signal is within the tolerance level associated with said display signal parameter, said processor selecting one of the matching modes according to a pre-determined scheme, a display screen for displaying images; and a controller for processing said analog display signal using said selected matching mode to display said plurality of images encoded in said analog display signal on said display screen.

* * * * *